US007367907B1

(12) United States Patent
Sutton et al.

(10) Patent No.: US 7,367,907 B1
(45) Date of Patent: May 6, 2008

(54) TRI-SURFACE TABLE TENNIS GAME

(76) Inventors: William M. Sutton, P.O. Box 3088, Carlsbad, NM (US) 88221; Thomas Martinez, 702 N. Canal, Carlsbad, NM (US) 88220

( * ) Notice: Subject to any disclaimer, the term of this patent is extended or adjusted under 35 U.S.C. 154(b) by 0 days.

(21) Appl. No.: 11/600,574

(22) Filed: Nov. 16, 2006

Related U.S. Application Data

(60) Provisional application No. 60/737,493, filed on Nov. 17, 2005.

(51) Int. Cl.
*A63B 67/04* (2006.01)

(52) U.S. Cl. ..... 473/496

(58) Field of Classification Search ..... 473/469, 473/475, 496; 108/59, 64, 65
See application file for complete search history.

(56) References Cited

U.S. PATENT DOCUMENTS 3,452,985 A * 7/1969 D'Zmura ..... 473/475
3,622,156 A * 11/1971 Pugsley ..... 473/496
3,655,187 A * 4/1972 Pugsley ..... 473/469
4,108,434 A * 8/1978 Royer ..... 473/475
4,335,877 A * 6/1982 Long ..... 473/475
4,522,395 A * 6/1985 Arndt ..... 473/475
D329,063 S * 9/1992 Kantor ..... D21/355
5,674,139 A * 10/1997 Brooks ..... 473/473
2004/0005941 A1* 1/2004 Chen ..... 473/496

* cited by examiner

*Primary Examiner*—Raleigh W. Chiu
(74) *Attorney, Agent, or Firm*—Alberto A. Leon, Esq.; Bauman, Dow & Leon, P.C.

(57) ABSTRACT

The invention relates to a tri-surface table tennis table and method of use, the tennis table comprising a configuration achieved placing three regulation tennis table surfaces next to each other to form a symmetrical arrangement, so that two of each surface's vertexes touch another surface's vertex, with each two touching vertexes forming a 120° angle. The invention also comprises a triangular surface that fits in the hole created in the center of the tri-surface configuration to form a smooth surface holding the three tennis table surfaces together, and a trilateral net structure further comprising three pieces of net, each piece of net having an inner end and an outer end, wherein the three inner ends are attached to one another and centered on the tri-surface table tennis table and the outer ends are one hundred twenty degrees apart, running to the three touching vertexes of the three playing surfaces.

3 Claims, 2 Drawing Sheets

TRI-SURFACE TABLE TENNIS GAME

CROSS-REFERENCE TO RELATED APPLICATION

I hereby claim the benefit under Title 35, United States Code Section 119(e) of any United States Provisional application(s) listed below:

Application No. 60/737,493

Filing Date: Nov. 17, 2005

BACKGROUND OF THE INVENTION

1. Technical Field of the Invention

This invention generally relates to games. More specifically, this invention relates to table games and table tennis games.

2. Description of the Background Art

According to various history sources, games predate written history and are considered a vital part of humans' social evolution. The competition inherent in participating in, or in playing, games has fascinated people since they realized survival was indeed a competition. This basic premise has evolved over time. In today's society, many every day common events, as well as very peculiar manufactured situations have formed the underlying basis for various games. This is demonstrated by the ever-growing popularity of television game shows, including reality-based game programs.

Historical records show Table Tennis began as an after dinner amusement, social hobby for upper class Victorians in the 1880's in England. Initially, the game mimicked its outdoor tennis predecessor in an indoor setting. In the early day development of table tennis, every day objects acted as equipment. For example, a line of books could be a net, a rounded top of a cork or knot of string could be the ball, and a cigar box the paddle. The game was initially played on dining room tables using cork balls. Over the years, the game underwent important changes in England, including the introduction of a celluloid ball which became commercially available in the U.S. at the turn of the century. Another early innovation was the pimpled rubber to cover the wooden paddle. Perhaps as early as 1884, the English sporting goods house of F. H. Ayres Limited—later absorbed by Slazengers—was selling a lawn tennis game "played with miniature rackets." Although that game could be conceivably played on a table, it was designed to be played on a green baize court laid on the floor.

Table tennis has increased in popularity over the decades and was introduced as an Olympic sport in 1988. In 2000, 40 mm balls replaced the old 38 mm balls in order to increase the ball's air resistance and effectively slow down the game. That change will make the game described and claimed in this invention more appealing and easier to play.

Many table tennis-based inventions have been disclosed and marketed. Most commonly, those inventions have disclosed and/or claimed new materials or methods to manufacture table tennis equipment. In contrast, the present invention comprises a new and useful tennis table game, which takes table tennis to an innovative level of skill and entertainment.

SUMMARY OF THE INVENTION

The apparatus of the present invention, which will be marketed using the trademark Trinnis™, comprises a configuration achieved placing three regulation tennis table surfaces next to each other to form a symmetrical arrangement, so that two of each surface's vertexes touch another surface's vertex, with each two touching vertexes forming a 120° angle. The preferred embodiment of the invention also comprises a pre-cut triangular piece that fits in the void or hole created in the center of the tri-surface configuration to form a smooth surface, and serves the additional purpose of holding the three tennis table surfaces together. The present invention also comprises a trilateral net structure, further comprising three pieces of net of equal length and width, each piece of net having an inner end and an outer end, wherein the three inner ends are attached to one another and centered on the tri-surface table tennis table and the outer ends of the resulting trilateral net are one hundred twenty degrees apart, running to the three touching vertexes of the three tennis table playing surfaces. The trilateral net structure is attached to the table tennis table using c-clamps commercially available for table tennis nets.

In an alternative embodiment of the invention, the same configuration is achieved using three specially designed and manufactured table tennis surfaces, each surface comprising an apex at one end, each surface being capable of engaging to one another at their respective apexes forming a triangular center area which can be fitted with a tri-net arrangement, as shown and illustrated in the accompanying drawings. The arrangement disclosed herein can be manufactured using materials suitable for commercially available table tennis structures. The present invention can be manufactured to correspond to three regulation size table tennis tables, including all the dimensions of, and lines on, each surface, and the distances to the nets.

The present invention also comprises a method of using a Trinnis™ table by following the playing rules set forth below. The method of the present invention can be practiced using standard, commercially available equipment, including table tennis balls, lower frames for the table tennis table and their attaching means, table tennis net attaching means and paddles. As set forth below, the game disclosed and claimed herein can be played by as few as two players, one on each of two sides of the tri-surface table. The game of this invention can be played comfortably by as many as 6 players, two on each end of the tri-surface table, or any number between 2 and 6, with any desired distribution of players on each end of the tri-surface table.

Specifically, the method of playing the game of this invention can be comprises the steps of:

1. Scoring: the first of any number of players, or doubles teams, who first score 21 points, wins the game. However, a player or team must win by two points so a game could go on to a higher number of points before being decided. A match is usually the majority in a set number of games. In other words, if player or team loses the first game it's not the end of the world; winning the next games can make a player or team who lost the first game the winner.
2. Choice of Positions and Service: the players can determine using any turn determination method which player or team will start serving and which player stands at which end of the Trinnis™ table. The player or team who wins the turn determination contest can choose to serve or to receive from any position in the table he/she/they want. After each game, each player or team rotates to the right and plays from the resulting position. Should there be a tie, for instance, each team has won one game, the player or team will rotate to the right after the leading player or team reaches 10 points in the final game.

3. Serving: each player or team must stand behind the outside end of his/her/their table. The serving player can hold the ball in the palm of his/her free hand and throw the ball straight up in the air. As the ball falls, the serving player must hit it so it lands on his/her one-third of the table, makes one bounce, and lands on the other side of one of the other two surfaces. If the serve touches the net, it is a let, and the server must serve again. If the serve touches the net and lands on the floor, the server loses a point. If the serve goes into the net, the server loses the point. The serving team serves until five points have been scored, and then the next player or team to the right gets to serve for the next five points. The first player or team reaching 21 points is the winner. The winning player or team must win by two points. In case of a tie, the players or teams alternate the serve after each point.
4. The Server: the server is the player who starts the game by being the first to put the ball into play. The server may serve to either surface adjacent to his/her position.
5. The Receiver: The receiver is the player who receives the ball from the server and returns it over the net. The receiver may return the ball to either of the two other positions. The receiver must avoid the ball bouncing more than once on his/her receiving area and must hit the ball only once each time to return it. If the receiver's return touches the net and goes over, there is no scoring event. If the ball goes into the net, the receiver loses one point. If any player's or team's return goes over the net but misses the table, that player or team loses one point. Like in regular table tennis, any returning ball which hits the edge of an opposite surface without being returned, results in an award of a point to the hitting player or team. Any and all other table tennis rules relating to scoring apply to Trinnis™.
6. Win a Point: if a player or team fails to return a shot a point is awarded to the hitting player or team. As in table tennis, a shot can hit the boundary lines (white lines) on the opponent's side or even the edge of the table and it is legal. A server's serve can also hit the edge and it is legal. If the hitter's shot lands on an opponent's paddle before it touches the floor or wall a point is awarded to the hitting player or team. The idea behind this rule is to prevent any volley play.
7. Lose a Point: a number of instances will result in the loss of a point which will be awarded to an opponent player or team. For example, if when attempting to serve or make a return, a player: misses the ball; hits the ball into the net, including the top of the net, and it comes back to the hitter's side of the table; hits the ball wide or too far so the first bounce hits the floor or the wall; hits the ball before it bounces on his/her side of the table; allows the ball to bounce twice on his/her side of the table before hitting it; moves the table or touches the net during play; or attempts to volley, a point will be awarded to the opponent who served or hit the ball legally immediately before the incident being described.
8. Legal Point: it is legal to hit the ball around the side of the net to land the ball on either opponent's side.

A prime objective of this invention is to provide a new, useful and non-obvious variation of table tennis, comprising a tri-surface table, and a three-sided net arrangement mimicking a symmetrical "Y" as further illustrated and shown in the accompanying drawings and photographs.

Another objective of this invention is to provide for a set of rules which allows the users to play and enjoy the game of this invention.

Another objective of this invention is to provide a table tennis-like game that can be played using standard, commercially available table tennis equipment.

The present invention resides not in any one of the specific structures and objectives set forth herein above per se, but rather in the combination of all of the invention's features for the functions specified. There are additional features of the inventions that will be specified hereinafter and/or illustrated by the drawings attached hereto. Those skilled in the art to which the invention pertains will appreciate the flexibility offered by the present invention in that the conception upon which this application is based, may be utilized as the foundation for designing and building other structures, arrangements, methods and systems for carrying out the multiple purposes of the present invention. It is therefore important that this disclosure be regarded as including such equivalent arrangements insofar as they do not depart from the scope and spirit of the invention as disclosed herein.

The foregoing has outlined, in general, the physical aspects of the invention and a method of use, and is to serve as an aid to better understand the more complete detailed description, which is fully illustrated by the drawings and photographs that follow. The present invention is by no means limited to the method or detail of construction, fabrication, material, or application of use described, illustrated and claimed herein. Any other variation of fabrication, use, or application should be considered apparent as an alternative embodiment of the present invention.

It is further intended that any other embodiments of the present invention that result from any changes in application or method of use or operation, method of manufacture, shape, size, or material which are not specified within the detailed written description or illustrations contained herein are considered apparent or obvious to one skilled in the art are within the scope of the present invention.

BRIEF DESCRIPTION OF THE VARIOUS VIEWS OF THE DRAWINGS

DETAILED DESCRIPTION OF THE PREFERRED EMBODIMENT OF THE INVENTION

Figure 1:
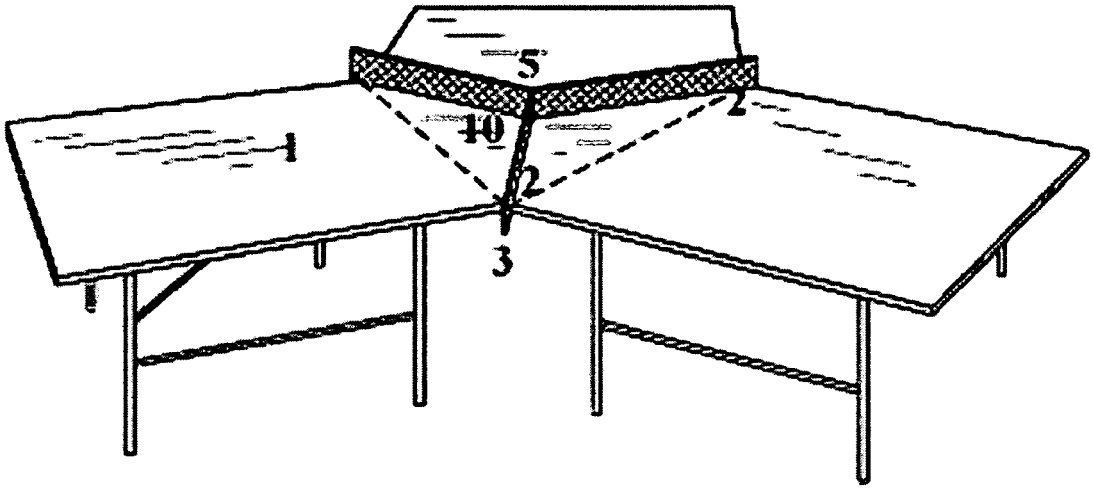
FIG. 1 is an elevated view of the tri-surface table tennis table of this invention.
Figure 2:
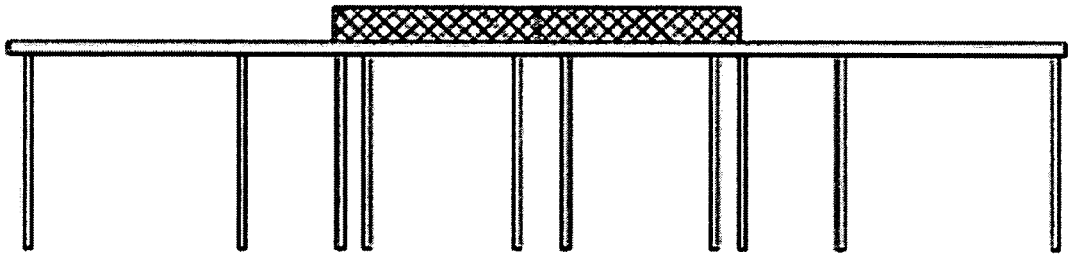
FIG. 2 is a side view of the tri-surface table tennis table of this invention sitting on a standard table tennis table frame.
Figure 3:
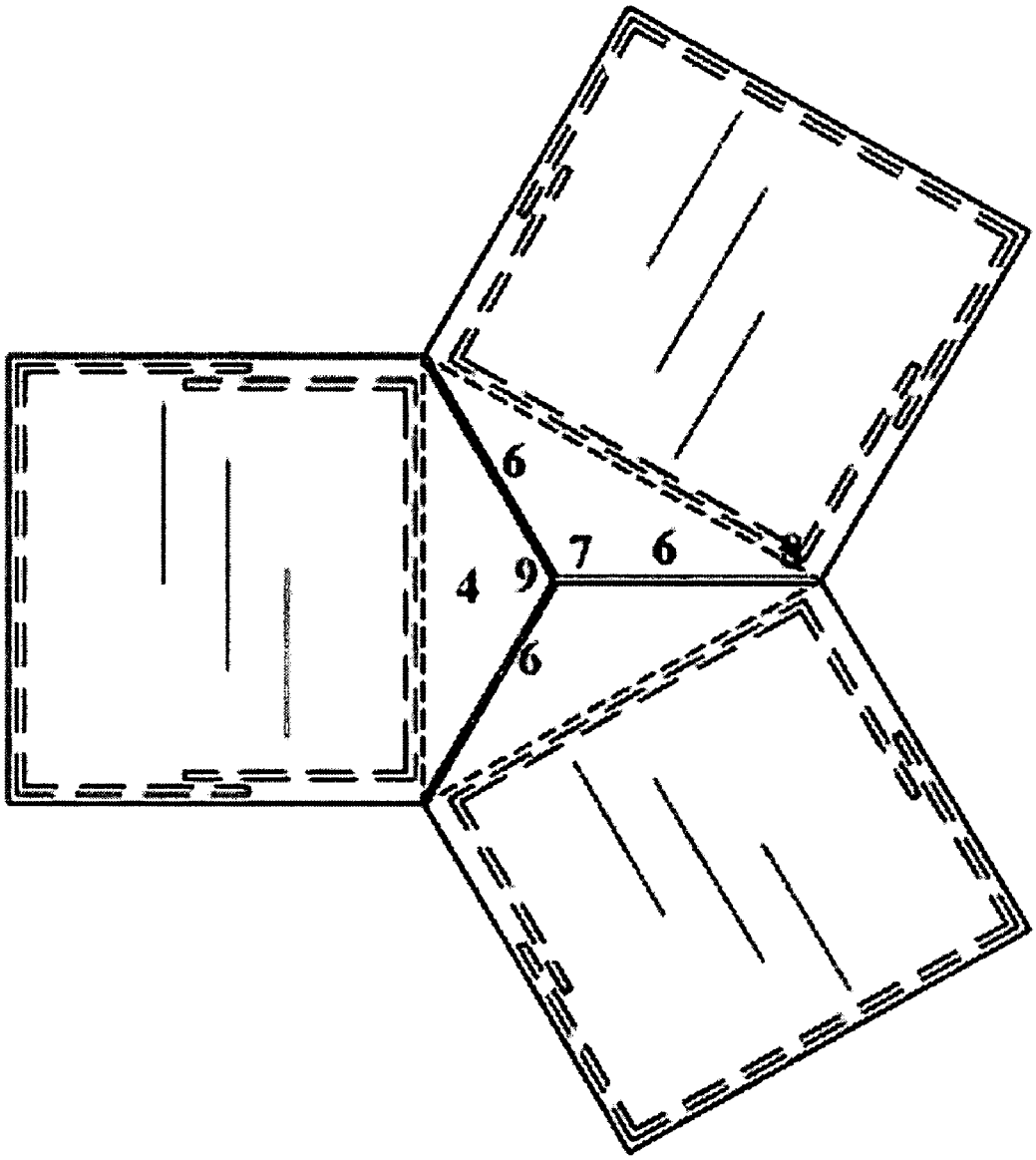
FIG. 3 is a top view of the tri-surface table tennis table of this invention.

As is apparent from FIG. 1, the preferred embodiment of the present invention comprises a configuration achieved by placing three regulation tennis table surfaces 1 next to each other to form a symmetrical arrangement, so that two of each surface's vertexes 2 touch another surface's vertex 2, with each two touching vertexes 2 forming a 120° angle 3. The preferred embodiment of the invention also comprises a pre-cut triangular piece 4 that fits in the void or hole created in the center of the tri-surface configuration to form a smooth surface, and serves the additional purpose of holding the three tennis table surfaces together using standard metal clasps for attaching table leaves to one another. The invention also comprises a tri-lateral net structure 5, further comprising three pieces of net 6 of equal length and width, each piece of net having an inner end 7 and an outer end 8, wherein the three inner ends are attached to one another forming a center point 9, which center point is located at the center of the tri-surface table tennis table and the outer ends of the resulting trilateral net 10 are one hundred twenty degrees apart, running to the three touching vertexes 2 of the three tennis table playing surfaces as further illustrated in FIGS. 1 and 3.

What is claimed is:

1. A tri-surface table tennis table, comprising:

a. three table tennis playing surfaces, each table tennis playing surface comprising two lateral sides, a back side facing a playing position and a front end, said front end comprising two sides and three vertexes, so that a side and two vertexes of one surface touch a side and two vertexes of another surface when said three table tennis playing surfaces are aligned at one hundred twenty degrees from each other to create said tri-surface table tennis table;

b. a lower frame;

c. a means to attach said table tennis playing surfaces to said lower frame, wherein the means to attach is selected from the group consisting of commercially available screws, clamps, and nuts and bolts;

d. a means to join said three table tennis playing surfaces in such a way that a tri-surface table tennis table results that allows three sets of players to participate rather than two, wherein the means to join comprises commercially available metal clasps;

e. a trilateral net structure, comprising three pieces of net of equal length and width, each having an inner end and an outer end, wherein the three inner ends are attached to one another and centered on the tri-surface table tennis table and the outer ends of the net are one hundred twenty degrees apart, running to the three touching vertexes of the three tennis table playing surfaces; and f. a means to attach the outer ends of said trilateral net structure to said table tennis playing surface vertexes, wherein the means to attach comprises commercially available c-clamps.

2. The tri-surface table tennis table according to claim 1, wherein the three table tennis playing surfaces are rectangular, corresponding to standard table tennis table halves, and a center piece shaped as an equilateral triangle fits into a void or hole created in the center of the three playing surfaces to create a smooth, continuous playing surface to which the trilateral net is affixed.

3. The tri-surface table tennis table according to claim 1, wherein the three table tennis playing surfaces are pentagonal, shaped as a standard rectangular half of a table tennis table, coming to an apex with a one hundred twenty degree angle at the front end of the playing surface, each surface being capable of engaging to one another at their respective apexes, wherein the trilateral net is attached along the seams where the three table tennis playing surfaces come together.

* * * * *